US005311969A

United States Patent [19]

Dickover et al.

[11] Patent Number: 5,311,969

[45] Date of Patent: May 17, 1994

[54] ARTICLE CHECKOUT SYSTEM WITH ENHANCED THROUGHPUT

[75] Inventors: Wesley D. Dickover, Pampano Beach; Chester N. Tingler, Boca Raton, both of Fla.

[73] Assignee: CheckRobot, Inc., Deerfield Beach, Fla.

[21] Appl. No.: 105,777

[22] Filed: Aug. 12, 1993

Related U.S. Application Data

[63] Continuation of Ser. No. 852,642, Mar. 17, 1992, abandoned.

[51] Int. Cl.[5] ..... A47F 9/04

[52] U.S. Cl. ..... 186/61; 186/67; 186/68

[58] Field of Search ..... 186/52, 61, 66, 67, 186/68, 69; 235/383

[56] References Cited

U.S. PATENT DOCUMENTS

| | | | |
|---|---|---|---|
| 2,978,069 | 4/1961 | Shoffner | 186/66 |
| 4,401,189 | 8/1983 | Majewski | 186/69 X |
| 4,766,296 | 8/1988 | Barth | 235/383 |

FOREIGN PATENT DOCUMENTS

| | | | |
|---|---|---|---|
| 694179 | 9/1964 | Canada | 186/67 |

*Primary Examiner*—F. J. Bartuska
*Attorney, Agent, or Firm*—Robin, Blecker, Daley & Driscoll

[57] ABSTRACT

A checkout station for checking out articles selected for purchase and bearing UPC codes includes an island for checkout including a first checkout module, having a first UPC scanner and a first conveyor leading from the first scanner to a first bagging area. A first customer passageway extends lengthwise along one side of the first conveyor. A cashier station is adjacent a second side of the first conveyor. A second checkout module, having a second UPC scanner and a second conveyor leading from the second scanner to a second bagging area and having one side adjacent the cashier station. A second customer passageway extends lengthwise along the other side of the second conveyor. Checkout is practiced by a customer scanning article UPC and an operator (cashier) processing payment, increasing throughput. Throughput improvement is further enhanced by providing a bagging area adjacent an exit of the conveyor and divider apparatus operable for placing a portion of the bagging area in communication with the conveyor exit correspondingly with the size of the customer order. The divider apparatus is further operable for isolating from the conveyor exit that bagging area which is not placed in communication with the conveyor exit.

8 Claims, 4 Drawing Sheets

ARTICLE CHECKOUT SYSTEM WITH ENHANCED THROUGHPUT

This is a continuation application under 37 CFR 1.62 of prior application Ser. No. 852,642, filed Mar. 17, 1992, now abandoned.

FIELD OF THE INVENTION

This invention relates generally to the checkout of articles in supermarkets and like facilities and pertains more particularly to improved check out stations and systems.

BACKGROUND OF THE INVENTION

U.S. Pat. Nos. 4,676,343 and 4,792,018, commonly-assigned herewith, set forth systems for operator-unattended checkout with particular concern for detection of customer fraud and deterrence of the same.

In the '343 patent, an article selected for purchase has its universal product code (UPC) scanned by a code reader and the code reader output signals effect the fetching from storage of a signal indicative of a measurable characteristic of the article. The article is placed on a conveyor and led thereby into a security zone defined by inlet and outlet light curtains. In the security zone, the measurable characteristic of the selected article is measured by a sensor and the sensor provides an output signal indicative of the measurement. A comparison is made of the sensor output signal and the fetched signal and, if the comparison is favorable, the conveyor continues to move in an article acceptance sense. Should the comparison be negative, the movement of the conveyor is reversed and the article placed on the conveyor is returned to the customer.

While the commonly-assigned patents describe their systems as operator-unattended, practical implementation thereof has led to a re-characterization thereof as systems requiring limited operator assistance, vastly less than the conventional, fully operator-attended systems theretofore known. Typically, an employee is assigned to a prescribed number of checkout counters and floats therebetween as assistance is required.

In typical current implementations of checkout systems in accordance with the commonly-assigned patents, on completion of the activity of the security system, indication is provided by the security system to a POS (point of sale) system of the installation of the acceptance of a given UPC-scanned article selected for purchase. The indication is conveyed to an interface which mates the security and POS systems. The POS system includes a store of article prices correlated with UPC indications and is responsive to the acceptance indication and the UPC indication for a given article to fetch the stored price of the article and to proceed with price totalization for a consumer order, seriatim per selected and accepted article.

One basis for the need for some operator assistance derives from the failure, at times, of the POS system price store to have pricing data for a selected article. In currently implemented systems, the POS system advises the security system, through the interface, of this aberration and the selected article is rejected.

Heightened operator assistance attends the described situation, since all article rejections for failure of price information require an operator to assist in the checkout. In the described situation, the operator is required to determine the selected article price and to furnish the price by key input to the POS system.

A system and method for averting need for continued operator assistance for price input in installations following the '343 and '018 patents is set forth in a commonly-assigned, copending application, entitled "ARTICLE CHECKOUT SYSTEM WITH PRICE PARAMETER OVERRIDE CAPACITY".

Another basis for the need for some operator assistance derives from article supplier activity not keyed into the security data base by the manager of the facility using the system, typically a food market supermarket. By way of example, in a promotional effort for a given article, a further article may be affixed thereto as an award for purchase of the article. This gives rise to a size characteristic which compares negatively with the stored size characteristic for the article absent its companion.

Heightened operator assistance attends the described situation, since all article rejections by the checkout system require an operator to assist in the checkout, e.g., as in bypassing the system for the rejected article. While the above example is a size discrepancy, article suppliers will at times change the weight aspect of an article, e.g., by changing a container from plastic to glass or vice versa. Weight discrepancy likewise gives rise to article rejection and need for operator assistance.

A system and method for averting need for continued operator assistance for size or weight input in installations following the '343 and '018 patents is set forth in a commonly-assigned, copending application, entitled "ARTICLE CHECKOUT SYSTEM WITH SECURITY PARAMETER OVERRIDE CAPACITY".

In conventional article checkout, a cashier scans the articles for about one-half of the order checkout time and does tendering (payment acceptance) and finalizing operations for the other one-half or so of the order checkout time. In the operator-unattended checkout system, the customer does the article scanning and is less efficient than the cashier. However, since tendering occurs remotely from the checkout station, at a paystation, the time to perform checkout in the operator-unattended system can equate with the operator-attended system. In either variety of checkout system, if there can be an increase in the usable time of the article code scanner, throughput can be increased accordingly.

SUMMARY OF THE INVENTION

The present invention has as its primary object the enhancement of throughput in operator-attended and operator-unattended checkout systems.

In attaining such objective, for operator-unattended checkout systems, the invention looks to a certain lane configuration and employs a customer to participate, to the extent of scanning the UPC of articles selected for purchase, and calls for operator involvement in tendering activity.

The lane configuration of the invention comprises an island for checkout including a first checkout module, having a first UPC scanner and a first conveyor leading from the first scanner to a first bagging area. A first customer passageway extends lengthwise along one side of the first conveyor. A cashier station is adjacent a second side of the first conveyor.

A second checkout module, having a second UPC scanner and a second conveyor leading from the second scanner to a second bagging area and having on side adjacent the cashier station. A second customer passageway extends lengthwise along the other side of the second conveyor.

As will be discussed in further detail below, the lane configuration of the invention permits substantially continuous article scanner usage, i.e., one of the first and second scanners is in use in successive, indeed, overlapping time periods. Likewise, following the scanning of articles by a first customer, an operator is substantially continuously occupied in tendering activity. Throughput is accordingly enhanced over that obtaining over a conventional, operator-attended checkout station. The invention looks also to further improved throughput, as now discussed.

Commonly-assigned U.S. Pat. No. 4,766,296 discloses an improved checkout counter wherein checkout efficiency is increased by isolating a first portion of a bagging area to containment of articles of a prior order checkout, while concurrently making a second portion of the bagging area accessible to receipt of articles of a current order checkout.

The arrangement of the '296 patent includes a conveyor for transport of articles following UPC (universal product code) scanning thereof to the bagging area. A fixed divider is located in the bagging area and a movable divider is rotatable into one of two positions. In a first position, the movable divider is aligned with the conveyor, permitting access to the first portion of the bagging area, i.e., that extending from the conveyor exit to the fixed divider. In a second position, the movable divider is athwart the conveyor, blocking communication of the conveyor with the first portion of the bagging area and providing access sidewardly of the conveyor into the second portion of the bagging area.

A controller is responsive to customer inputs, output of the UPC scanner and sensors disposed along the conveyor to position the movable divider.

The '296 patent addresses a problem of significance in article checkout efficiency, namely, the lessening of throughput of the prior art checkout stations attributable to need to await the processing of a second customer order until completion of bagging of prior customer order. Throughput is lessened correspondingly with station idle time, i.e., time during which the scanner is not in use. By providing for isolation of the current order in a first portion of the bagging area, the system of the '296 patent increases throughput by enabling scanning of the articles of the second customer order during the bagging of the prior customer order.

While such improvement in efficiency of checkout is afforded by the system of the '296 patent, one shortcoming thereof is noted. Where a customer order being moved to either of the two bagging area portions is larger than the size of the bagging area portion, access cannot be given to the other bagging area portion until the conveyor is cleared of the current customer order from the conveyor. During such periods, throughput decreases to its level absent the '296 patent advantage.

The subject invention provides such advantage by overcoming the above-noted problem of idle time in the system of the '296 patent. To this end, the invention correlates bagging area portion size with customer order size. In its preferred embodiment, the invention provides in a checkout station, comprising a conveyor for transport of articles, a bagging area adjacent an exit of the conveyor and divider apparatus operable for placing a portion of the bagging area in communication with the conveyor exit correspondingly with the size of the customer order. The divider apparatus is further operable for isolating from the conveyor exit that bagging area which is not placed in communication with the conveyor exit.

In its preferred embodiment, the divider apparatus includes first and second members, respectively a divider member and a channeling member supported for respective independent rotational movement relative to the conveyor about a common center of rotation.

In its last-described throughput enhancement, the invention will be appreciated as applicable to conventional article checkout stations or to operator-unattended checkout stations.

Incorporating reference is hereby made to the three above-noted commonly-assigned patents.

The foregoing and other objects and features of the invention will be further understood from the following detailed description of preferred embodiments and practices thereof and from the drawings, wherein like reference numerals identify like components throughout.

DETAILED DESCRIPTION OF PREFERRED EMBODIMENTS AND PRACTICES

Figure 1:
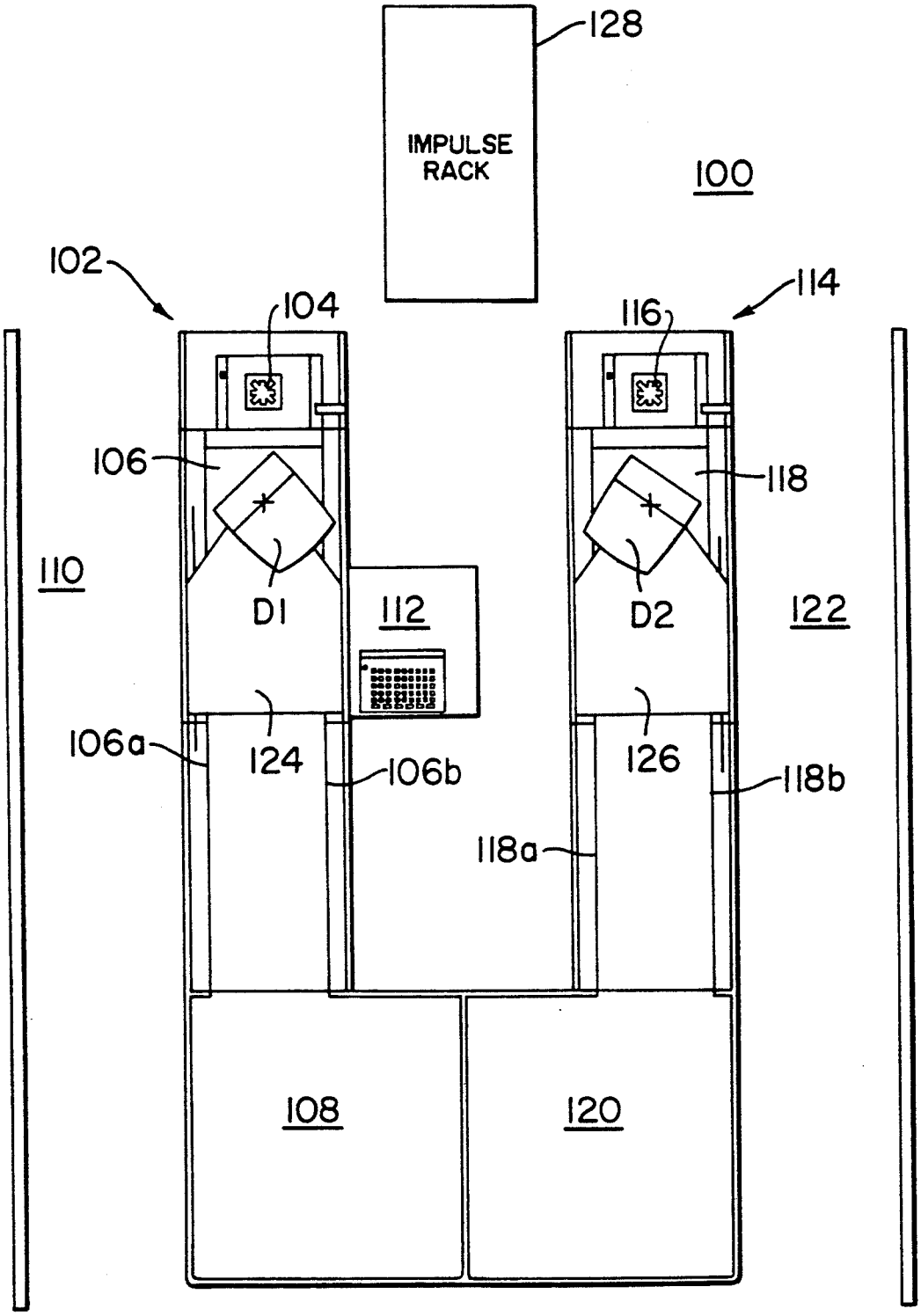
FIG. 1 is a schematic plan view of a checkout island having a lane configuration in accordance with the invention.

Referring to FIG. 1, checkout island 100 includes a first checkout module 102, having a first UPC scanner 104 and a first conveyor 106 leading from first scanner 104 to a first bagging area 108. As is shown and discussed in the '343 and '018 patents, the conveyor 106 may be constituted of first and second independently driven conveyors. A first customer passageway 110 extends lengthwise along one side **106*a* of first conveyor 106. A cashier station 112 is adjacent a second side 106*b*** of the first conveyor.

A second checkout module 114, has a second UPC scanner 116 and a second conveyor 118 leading from second scanner 116 to a second bagging area 120 and having one side **118*a* adjacent cashier station 112. A second customer passageway 122 extends lengthwise along the other side 118*b* of second conveyor 118**.

Display units D1 and D2 may be provided for displaying instructions to customers and may be customer-interactive as is described in the commonly-assigned patents incorporated by reference. Security zones 124 and 126 may be incorporated along conveyors 106 and 118, where the installation includes the various security measures discussed in the patents incorporated by reference. Display units D1 and D2 may be supported atop the structure of the respective security zones 124 and 126, or otherwise supported in the absence thereof. Impulse rack 128 may be disposed so as to service both of customer passageways 110 and 122.

In use of checkout island 100, an operator takes position at the cashier station 112 and a first customer scans article UPC seriatim of articles selected for purchase through the use of one of scanners 104 and 116. The articles are then placed on the associated conveyor and conveyed to the associated bagging area. On completion of scanning the UPC of the last article selected for purchase, the customer advances to a position opposite the operator and tenders payment for the order. The customer or bagger then bags the customer order.

Through display units D1 and D2, a second customer, in the other customer passageway is advised to use the scanner thereof in the course of first customer scanning, as below discussed.

Figure 2:
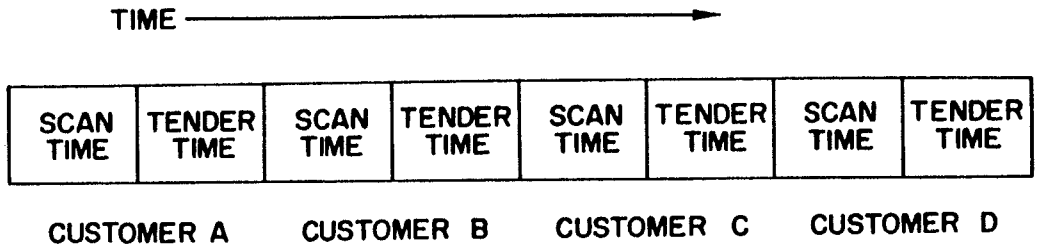
FIG. 2 is a schematic illustration illustrating the timing of events in a conventional, operator-attended checkout lane.

Referring now to FIG. 2, the chronology of checkout events attending the conventional, operator-attended checkout station is noted as Scan Time and Tender Time for a series of successive customers A, B, C and D. Both events are performed for each customer by the operator, i.e., UPC scanning and acceptance of tender.

Figure 3:
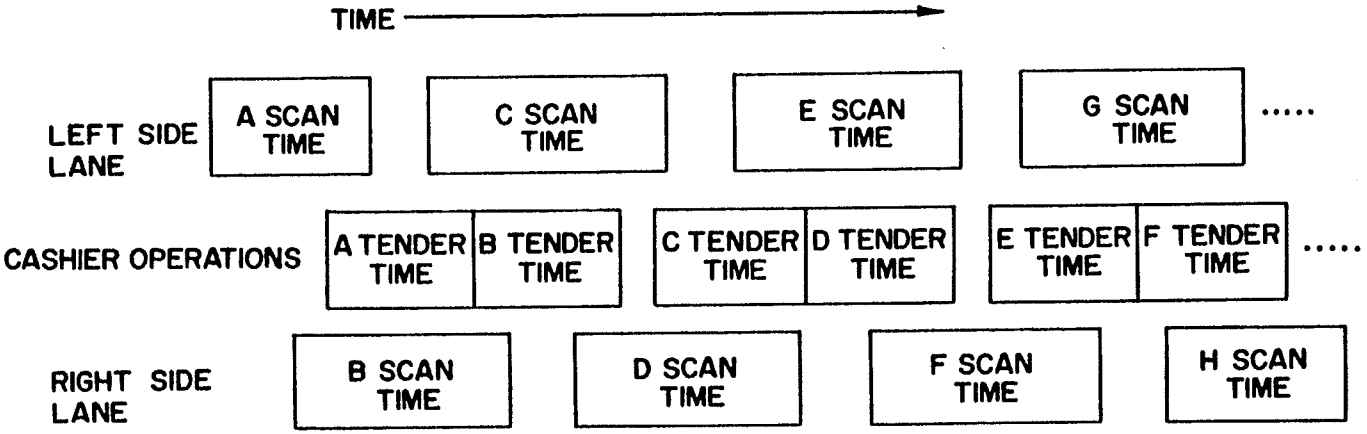
FIG. 3 is a schematic illustration illustrating the timing of events in a the checkout island of FIG. 1.

FIG. 3 is rendered in the same time scale as FIG. 2 and depicts the chronology of checkout events attending usage of checkout island 100 of FIG. 1.

In FIG. 3, customer A effects UPC scanning in a time period which is more extended than that of the operator in FIG. 1, given the lesser efficiency of the customer in UPC scanning. The operator is idle during such opening time period. Amidst customer A scanning of UPC, customer B is advised through displays D1 and D2 to commence scanning of UPC.

At the close of customer A scanning, customer A tender time occurs, i.e., as illustrated, concurrently with customer B scanning of UPC. The operator may be occupied, as indicated by A Tender Time in FIG. 3, for the period extending from the close of customer A scanning of UPC to the end of scanning of UPC by customer B. The scanning of UPC by customer C commences during that of customer B and the operator is active during such customer C scan time in B Tender Time.

The progress in FIG. 3 continues as illustrated and, as will be seen, customers A through F are accommodated in checkout in the time period for customers A through D in the FIG. 2 checkout situation. Indeed, full scanning by customer G and partial scanning by customer H is accomplished in such time period, despite the acknowledged lesser capability of the customer as a user of the UPC scanner.

The time chart of FIG. 3 affords time periods intervening tender time periods for customer assistance and other duties of the operator.

As will be appreciated, the configuration of checkout island 100 has the effect of enabling alternating on-time for the respective scanners, indeed overlapping on-times. Further, the operator labor is substantially continuous, assuming there to be continuous checkout demand, following the initial, customer A, scanning of UPC. Throughput is accordingly increased per FIG. 3 over that obtaining for FIG. 2.

As noted above, throughput is conditioned in some measure on the bagging area to be of sufficient size to accommodate the customer order. Thus, even with the advantage of the '296 patent in sharing a bagging area with successive customer orders, its benefit is undermined where a customer order remains on the conveyor and has not fully entered one of the two, fixed size bagging area portions.

Figure 4:
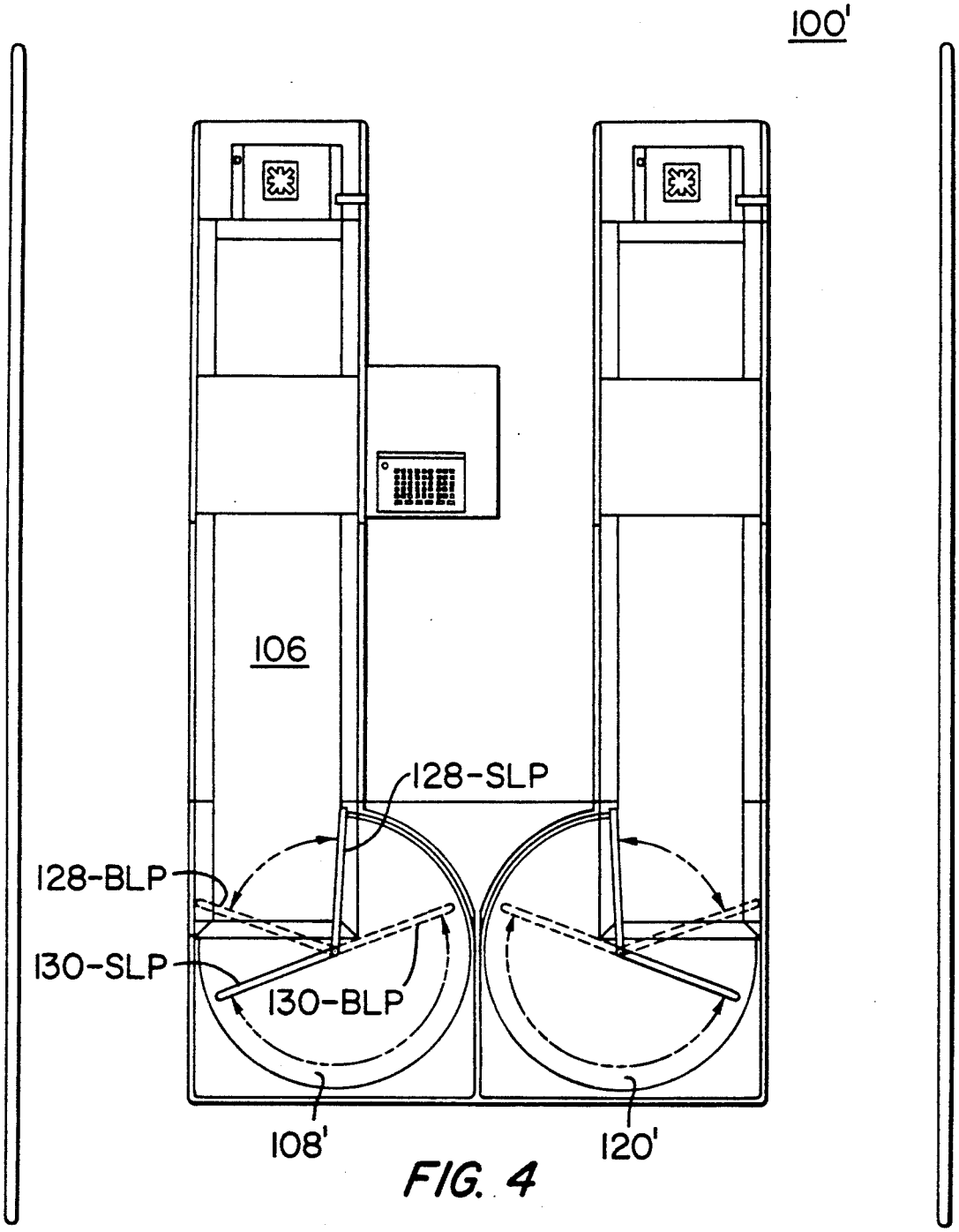
FIG. 4 is a schematic plan view of a further checkout island in accordance with the invention having the above-noted bagging area feature wherein bagging area portion sizes are correlated with customer order size.

Turning to FIG. 4, checkout island 100' is substantially as depicted in FIG. 1, with the display units not shown and the security zone in rectangular shape, however, with modified bagging areas 108' and 120'.

Describing bagging area 108', channeling member 128 corresponds to channeling member 36 of the '296 patent, i.e., it is movable to its illustrated solid line position 128-SLP in alignment with conveyor 106 to provide access to the portion of bagging area 108' aligned with conveyor 106, responsively to conditions described in the '296 patent. It is also positionable in its broken line position 128-BLP, per conditions described also in the '296 patent, to provide access to the portion of bagging area 108' to the side of conveyor 106.

Bagging area dividing member 130 is akin to fixed divider 34 of the '296 patent, but differs therefrom in that is variably positionable, i.e., from its solid line position 130-SLP to its broken line position 130-BLP.

Figure 5:
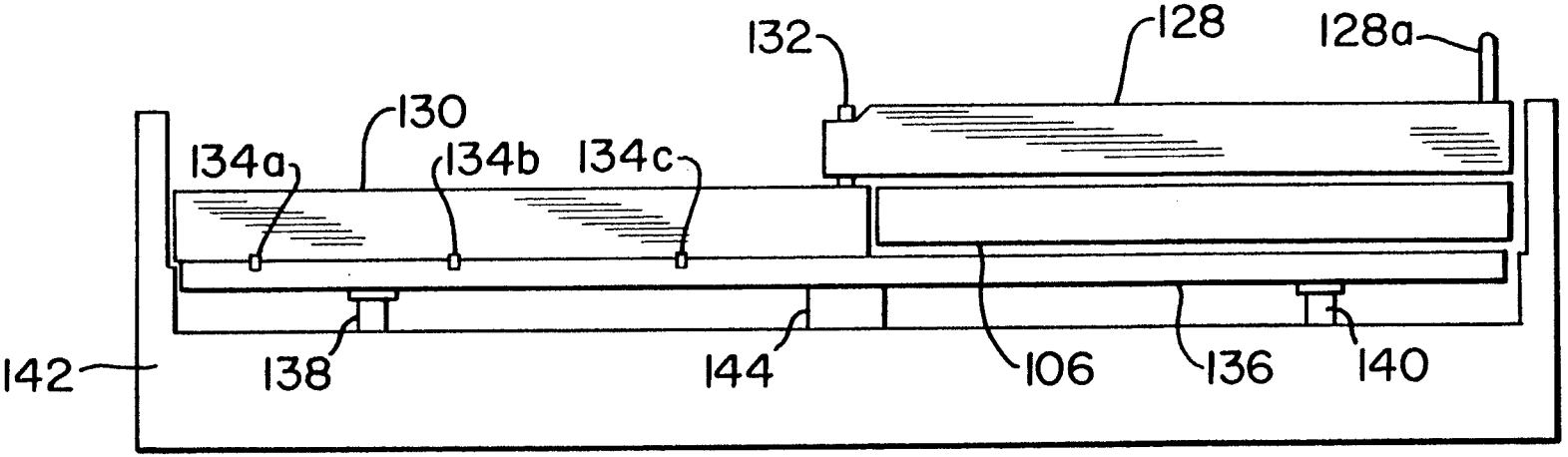
FIG. 5 is an illustration of a preferred support arrangement for the channeling and dividing members of divider apparatus of the invention.

As is shown in FIG. 5, channeling member 128 and dividing member 130 are preferably supported, respectively vertically successively, about a common pivot post 132. Channeling member 128 is fixed to pivot post 132 to rotate therewith on motor control of the angular position of the pivot post or by use of handle 128*a*. On the other hand, dividing member 130 is supported for rotation relative to pivot post 132. Thus, dividing member 130 is secured as at 134*a*, 134*b* and 134*c* to turntable 136, supported on rollers 138 and 140 on base 142 beneath conveyor 106. An adjustable friction clutch 144 is disposed on base 142 in engagement with turntable 136. Accordingly, it will be appreciated that dividing member 130 will be positionable at any location, under the influence of of force of purchased articles engaging dividing member 130 and overcoming the resistance of clutch 144, even to the extremity of the bagging area, i.e., commensurate with the size of the order being checked out.

In its presently discussed aspect, the invention further contemplates positive control of the positioning of dividing member 130, i.e., as by a motor driving turntable 136. In this connection, customer order size may be obtainable by sensing the areas of individual articles and accumulating the same, or by using the stored size-indicative signals in the '343 and '018 patents, to assess the needed size of the portion of the bagging area in communication with the conveyor.

Various changes in structure to the described checkout system and modifications in use thereof may evidently be introduced without departing from the invention. Accordingly, it is to be understood that the particularly disclosed and depicted embodiments are intended in an illustrative and not in a limiting sense. The true spirit and scope of the invention is set forth in the following claims.

What is claimed is:

1. An article checkout station for checking out a customer order, comprising:

(a) conveyor means for transport of articles;

(b) a bagging station adjacent an exit of said conveyor means;

(c) a first member rotatably supported for movement thereof in said bagging area; and (d) a second member rotatably supported for movement into a first position wherein said second member extends across said conveyor means and a second position wherein said second member extends generally aside said first member for providing respective different entry relations between said conveyor means and said bagging area when in said first and second positions, said first member being movable responsively to engagement of said first member with said customer order when said second member is in either of said first and second positions.

2. The invention claimed in claim 1 wherein said first and second members are supported for rotation about a common pivot independently of each other.

3. The invention claimed in claim 1 further including a turntable supporting said first member for rotation therewith.

4. The invention claimed in claim 3 further including a friction clutch in engagement with said turntable for resisting rotative movement thereof.

5. An article checkout station for checking out a customer order, comprising:

(a) an article code scanner;

(b) conveyor means for transport of articles upon code sensing thereof;

(c) a bagging station adjacent an exit of said conveyor means;

(d) a first member rotatably supported for movement thereof in said bagging area; and (e) a second member rotatably supported for movement into a first position wherein said second member extends across said conveyor means and a second position wherein said second member extends generally aside said first member for providing respective different entry relations between said conveyor means and said bagging area when in said first and second positions, said first member being movable responsively to engagement of said first member with said customer order when said second member is in either of said first and second positions.

6. The invention claimed in claim 5 wherein said first and second members are supported for rotation about a common pivot independently of each other.

7. The invention claimed in claim 6 further including a turntable supporting said first member for rotation therewith.

8. The invention claimed in claim 7 further including a friction clutch in engagement with said turntable for resisting rotative movement thereof.

* * * * *